US005860554A

United States Patent [19]

Ruffo

[11] Patent Number: 5,860,554

[45] Date of Patent: Jan. 19, 1999

[54] LOCKABLE LID SUPPORT

[76] Inventor: Michael Ruffo, 28 Kingsley Pl., Staten Island, N.Y. 10301

[21] Appl. No.: 623,910

[22] Filed: Mar. 28, 1996

[51] Int. Cl.[6] ..... B65D 43/00

[52] U.S. Cl. ..... 220/335; 217/60 C

[58] Field of Search ..... 220/335; 206/1.7, 206/1.8, 1.9, 541, 575; 217/60 C, 60 D

[56] References Cited

U.S. PATENT DOCUMENTS

| | | | |
|---|---|---|---|
| 406,595 | 7/1889 | Roemer | 217/60 C |
| 1,212,188 | 1/1917 | Couper | 206/1.8 X |
| 1,796,551 | 3/1931 | Wismer | 217/60 C |
| 1,986,307 | 1/1935 | Wagner | 217/60 C |
| 2,076,860 | 4/1937 | North | 217/60 C |
| 2,587,200 | 2/1952 | Nottingham | 217/60 C |
| 3,203,575 | 8/1965 | Anderson et al. | 220/335 |
| 3,452,803 | 7/1969 | Barnish et al. | 160/213 |
| 3,858,744 | 1/1975 | Garvert | 220/335 X |
| 5,022,689 | 6/1991 | Perdue, Jr. et al. | 292/19 |
| 5,287,596 | 2/1994 | Chen et al. | 16/331 |
| 5,348,144 | 9/1994 | Maier | 206/1.8 X |
| 5,379,487 | 1/1995 | Bowers | 16/240 |

*Primary Examiner*—Steven M. Pollard
*Attorney, Agent, or Firm*—Richard L. Miller, P.E.

[57] ABSTRACT

A lockable lid support that includes a mounting bracket, an arm, pivoting apparatus, and sliding and locking apparatus. The mounting bracket is removably mounted to a lid of a box that is pivotally mounted to a lower portion of the box. The arm is pivotally mounted at one end to the lower portion of the box and slidably and locking mounted at another end to the mounting bracket. The pivoting apparatus pivotally mounts the one end of the arm to the lower portion of the box, so that the lid of the box can be pivoted relative to the lower portion of the box from 0 degrees to 180 degrees. And, the sliding and locking apparatus slidingly and lockingly mounts the other end of the arm to the mounting bracket, so that when the lid of the box is pivoted relative to the lower portion of the box to a desired position the lid of the box is maintained in the desired position.

6 Claims, 1 Drawing Sheet

LOCKABLE LID SUPPORT

BACKGROUND OF THE INVENTION

The present invention relates to a lockable lid support. More particularly, the present invention relates to a lockable lid support that includes a track disposed on a side of a lid of a box, an arm having one end pivotally mounted to a side of the box and another end slidably mounted to the track, and locking apparatus for maintaining the lid in a desired position relative to the box.

Boxes of all sizes provide storage for a variety of different objects. Lids are provided to close these boxes and maintain their contents therein. When a person wishes to access the contents of the box, the lid must be opened. When the person searches for the objects the lid has a tendency to fall and impact on the hand of the user and inflict pain and injury thereto.

Another situation arises when the user does not require the lid to be fully opened and wishes the lid to be maintained in a specific position relative to the box. Also, if the lid were to open completely and left to rest behind the box, great strain will be induced on the hinges and cause premature failure or unintentional removal thereof.

Numerous innovations for closure locking devices have been provided in the prior art that will be described. However, even though these innovations may be suitable for the specific individual purposes to which they address, they differ from the present invention in that they do not teach a lockable lid support that includes a track disposed on a side of a lid of a box, an arm having one end pivotally mounted to a side of the box and another end slidably mounted to the track, and locking apparatus for maintaining the lid in a desired position relative to the box.

FOR EXAMPLE, U.S. Pat. No. 3,452,803 to Barnish et al. teaches a hinged self-locking closure device that includes a first door part that is hinged to one end of an aperture, a second door part that is hinged to the first door part or to the end of the aperture. Self-locking and unlocking is contained by a lock which in the closed position of the doors parts locks the doors parts together or locks the second door part to the aperture.

ANOTHER EXAMPLE, U.S. Pat. No. 5,022,689 to Perdue, Jr. et al. teaches a key lockable arrangement for locking two members in abutting relationship that includes a cylinder button mounted in the first member for turning therein and having elements on a lower portion thereof which an S-shape, to be received in a housing in the second member.

STILL ANOTHER EXAMPLE, U.S. Pat. No. 5,287,596 to Chen et al. teaches a hinge that includes a hinge body, a stop mechanism and a hold mechanism. The hinge body has specifically shaped knuckles to accomplish the stopping and holding functions.

FINALLY, YET ANOTHER EXAMPLE, U.S. Pat. No. 5,379,487 to Bowers teaches a hinge that includes two screws that are threaded into two holes in a hinge arm which is adapted to be assembled with a base plate by shifting the arm longitudinally to cause the screws to slide into the U-shaped slots in the plate. The slots perform longitudinal adjustment of the hinge arm.

It is apparent that numerous innovations for closure locking devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a lockable lid support that avoids the disadvantages of the prior art.

ANOTHER OBJECT of the present invention is to provide a lockable lid support that is simple and inexpensive to manufacture.

STILL ANOTHER OBJECT of the present invention is to provide a lockable lid support that is simple to use.

YET ANOTHER OBJECT of the present invention is to provide a lockable lid support that allows a person to lift a lid to any position and maintain it there by tightening a lock nut on a sliding arm.

STILL YET ANOTHER OBJECT of the present invention is to provide a lockable lid support that can be mounted on either the left or right side of the box.

YET STILL ANOTHER OBJECT of the present invention is to provide a lockable lid support that can be installed on the conventional box in matter of minutes.

STILL YET ANOTHER OBJECT of the present invention is to provide a lockable lid support that can manually maintain a lid in any position from 0 to 180 degrees inclusive.

YET STILL ANOTHER OBJECT of the present invention is to provide a lockable lid support that is very practical.

STILL YET ANOTHER OBJECT of the present invention is to provide a lockable lid support that can sustain a lot of weight without failing.

YET STILL ANOTHER OBJECT of the present invention is to provide a lockable lid support that can be mounted either on the outside or the inside of the box without having to rearrange any of the parts.

BRIEFLY STATED, STILL YET ANOTHER OBJECT of the present invention is to provide a lockable lid support that includes a mounting bracket, an arm, pivoting apparatus, and sliding and locking apparatus.

YET STILL ANOTHER OBJECT of the present invention is to provide a lockable lid support wherein the mounting bracket is removably mounted to a lid of a box that is pivotally mounted to a lower portion of the box.

STILL YET ANOTHER OBJECT of the present invention is to provide a lockable lid support wherein the arm is pivotally mounted at one end to the lower portion of the box and slidably and locking mounted at another end to the mounting bracket.

YET STILL ANOTHER OBJECT of the present invention is to provide a lockable lid support wherein the pivoting apparatus pivotally mounts the one end of the arm to the lower portion of the box, so that the lid of the box can be pivoted relative to the lower portion of the box from 0 degrees to 180 degrees.

STILL YET ANOTHER OBJECT of the present invention is to provide a lockable lid support wherein the sliding and locking apparatus slidingly and lockingly mounts the other end of the arm to the mounting bracket, so that when the lid of the box is pivoted relative to the lower portion of the box to a desired position the lid of the box is maintained in the desired position.

YET STILL ANOTHER OBJECT of the present invention is to provide a lockable lid support wherein the mounting bracket is slim, flat, and elongated and has a pair of ends that are removably mounted to a side of the lid of the box selected from the group consisting of inner right side, outer right side, inner left side, and outer right side.

STILL YET ANOTHER OBJECT of the present invention is to provide a lockable lid support wherein each of the pair of ends of the slim, flat, and elongated mounting bracket has a chamfered throughbore.

YET STILL ANOTHER OBJECT of the present invention is to provide a lockable lid support wherein the slim, flat, and elongated mounting bracket further has an inner surface with a longitudinally-disposed and concave ended recess that has a depth and extends longitudinally along the inner surface of the slim, flat, and elongated mounting bracket from a first proximity area which is in proximity to the chamfered throughbore of one of the pair of ends of the slim, flat, and elongated mounting bracket to a second proximity area which is in proximity to the chamfered throughbore of another of the pair of ends of the slim, flat, and elongated mounting bracket.

STILL YET ANOTHER OBJECT of the present invention is to provide a lockable lid support wherein the slim, flat, and elongated mounting bracket further has a longitudinally-disposed and concave ended throughslot that has a width and extends longitudinally along the slim, flat, and elongated mounting bracket from the first proximity area of the slim, flat, and elongated mounting bracket to the second proximity area of the slim, flat, and elongated mounting bracket.

YET STILL ANOTHER OBJECT of the present invention is to provide a lockable lid support wherein the longitudinally-disposed and concave ended throughslot of the slim, flat, and elongated mounting bracket opens into the longitudinally-disposed and concave ended recess of the inner surface of the slim, flat, and elongated mounting bracket.

STILL YET ANOTHER OBJECT of the present invention is to provide a lockable lid support that further includes mounting bracket mounting apparatus for removably mounting the mounting bracket to the lid of the box.

YET STILL ANOTHER OBJECT of the present invention is to provide a lockable lid support wherein the mounting bracket mounting apparatus includes screws that pass through the chamfered throughbore of each of the pair of ends of the slim, flat, and elongated mounting bracket and into the side of the lid of the box.

STILL YET ANOTHER OBJECT of the present invention is to provide a lockable lid support wherein the arm is slim, flat, and elongated and has a pair of ends.

YET STILL ANOTHER OBJECT of the present invention is to provide a lockable lid support wherein each of the pair of ends of the slim, flat, and elongated sliding arm has a throughbore.

STILL YET ANOTHER OBJECT of the present invention is to provide a lockable lid support wherein one of the pair of ends of the slim, flat, and elongated sliding arm is pivotally mounted to a side of the lower portion of the box selected from the group consisting of inner right side, outer right side, inner left side, and outer right side, by the pivoting apparatus.

YET STILL ANOTHER OBJECT of the present invention is to provide a lockable lid support wherein the pivoting apparatus is disposed below a one of the pair of ends of the slim, flat, and elongated mounting bracket that is closest to where the lid of the box is pivotally mounted to the lower portion of the box.

STILL YET ANOTHER OBJECT of the present invention is to provide a lockable lid support wherein another of the pair of ends of the slim, flat, and elongated sliding arm is slidably and lockingly engaged with the slim, flat, and elongated mounting bracket by the sliding and locking apparatus.

YET STILL ANOTHER OBJECT of the present invention is to provide a lockable lid support wherein the pivoting apparatus includes a block that has a pair of spaced-apart and chamfered throughbores and an intermediate throughbore that is disposed intermediate the pair of spaced-apart and chamfered throughbores of the block of the pivoting apparatus.

STILL YET ANOTHER OBJECT of the present invention is to provide a lockable lid support that further includes block mounting apparatus for removably mounting the block of the pivoting apparatus to the side of the lower portion of the box.

YET STILL ANOTHER OBJECT of the present invention is to provide a lockable lid support wherein the block mounting apparatus includes screws that pass through the pair of spaced-apart and chamfered throughbores of the block of the pivoting apparatus and into the side of the lower portion of the box.

STILL YET ANOTHER OBJECT of the present invention is to provide a lockable lid support wherein the intermediate throughbore of the block of the pivoting apparatus has a wide inner portion and a narrow outer portion that opens into the wide inner portion of the intermediate throughbore of the block of the pivoting apparatus.

YET STILL ANOTHER OBJECT of the present invention is to provide a lockable lid support wherein the wide inner portion of the intermediate throughbore of the block of the pivoting apparatus is wider than the narrow outer portion of the intermediate throughbore of the block of the pivoting apparatus.

STILL YET ANOTHER OBJECT of the present invention is to provide a lockable lid support wherein the pivoting apparatus further includes a swivel rivet that has a head and a distal end.

YET STILL ANOTHER OBJECT of the present invention is to provide a lockable lid support wherein the distal end of the swivel rivet of the pivoting apparatus passes through the throughbore of one of the pair of ends of the slim, flat, and elongated sliding arm and passes through the narrow outer portion of the intermediate throughbore of the block of the pivoting apparatus with the head of the swivel rivet of the pivoting apparatus resting on the one of the pair of ends of the slim, flat, and elongated sliding arm.

STILL YET ANOTHER OBJECT of the present invention is to provide a lockable lid support wherein the distal end of the swivel rivet of the pivoting apparatus enters the wide inner portion of the intermediate throughbore of the block of the pivoting apparatus where it widens to a width larger than that of the narrow outer portion of the intermediate throughbore of the block of the pivoting apparatus, so that the swivel rivet of the pivoting apparatus is prevented from unintentional removal from the block of the pivoting apparatus and the slim, flat, and elongated sliding arm is pivotally mounted to the block of the pivoting apparatus.

YET STILL ANOTHER OBJECT of the present invention is to provide a lockable lid support wherein the sliding and locking apparatus includes a rivet screw that has a proximal end and a threaded shaft with a distal end.

STILL YET ANOTHER OBJECT of the present invention is to provide a lockable lid support wherein the distal end of the threaded shaft of the rivet screw of the sliding and locking assembly passes through the longitudinally-disposed and concave ended throughslot of the slim, flat, and elongated mounting bracket and passes through the throughbore of another of the pair of ends of the slim, flat, and elongated sliding arm.

YET STILL ANOTHER OBJECT of the present invention is to provide a lockable lid support wherein the sliding and locking apparatus further includes a proximal washer that has a width and a thickness and is disposed on the proximal end of the rivet screw and is positioned in the longitudinally-disposed and concave ended recess of the inner surface of the slim, flat, and elongated mounting bracket.

STILL YET ANOTHER OBJECT of the present invention is to provide a lockable lid support wherein the width of the proximal washer of the proximal end of the rivet screw of the sliding and locking apparatus is greater than the width of the longitudinally-disposed and concave ended throughslot of the slim, flat, and elongated mounting bracket and the thickness of the proximal washer of the proximal end of the rivet screw of the sliding and locking apparatus is substantially equal to the depth of the longitudinally-disposed and concave ended recess of the inner surface of the slim, flat, and elongated mounting bracket, so that the lockable lid support is kept steady and will not rock back and forth.

YET STILL ANOTHER OBJECT of the present invention is to provide a lockable lid support wherein the sliding and locking apparatus further includes an intermediate washer that is disposed on the threaded shaft of the rivet screw of the sliding and locking assembly between the slim, flat, and elongated mounting bracket and the slim, flat, and elongated mounting bracket, so that the slim, flat, and elongated sliding arm is helped guided.

STILL YET ANOTHER OBJECT of the present invention is to provide a lockable lid support wherein the sliding and locking apparatus further includes a distal washer that is disposed on the threaded shaft of the rivet screw of the sliding and locking assembly adjacent a side of the slim, flat, and elongated sliding arm opposite to the intermediate washer of the sliding and locking apparatus, so that the slim, flat, and elongated sliding arm is helped guided.

YET STILL ANOTHER OBJECT of the present invention is to provide a lockable lid support wherein the sliding and locking apparatus further includes a hand turnable nut that is removably mounted to the distal end of the threaded shaft of the rivet screw of the sliding and locking apparatus adjacent to the distal washer of the sliding and locking apparatus.

FINALLY, STILL YET ANOTHER OBJECT of the present invention is to provide a method of using a lower portion of a box as a pallet and a storage area for painting supplies and a lid portion of the box that is pivotally mounted to the lower portion of the box as an easel, which includes the step of maintaining the lid portion of the box in a desired position relative to the lower portion of the box by a lockable lid support that includes a mounting bracket that is removably mounted to the lid of the box, an arm that is pivotally mounted at one end to the lower portion of the box and is slidably and locking mounted at another end to the mounting bracket, pivoting apparatus for pivotally mounting the one end of the arm to the lower portion of the box, so that the lid of the box can be pivoted relative to the lower portion of the box from 0 degrees to 180 degrees, sliding and locking apparatus for slidingly and lockingly mounting the other end of the arm to the mounting bracket, so that when the lid of the box is pivoted relative to the lower portion of the box to a desired position the lid of the box is maintained in the desired position.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
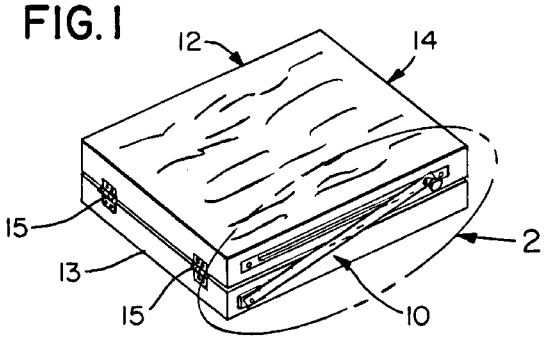
FIG. 1 is a diagrammatic perspective view of the present invention installed on a conventional box.

10 lockable lid support of the present invention
12 conventional box
14 pivotally mounted conventional box lid
15 conventional box hinges
16 slim, flat, and elongated mounting bracket
18 pair of mounting bracket free ends
20 mounting bracket free end chamfered throughbore
22 mounting bracket inner surface
24 mounting bracket inner surface longitudinally-disposed and concave ended recess
26 mounting bracket first free end proximity area
28 mounting bracket second proximity area
30 mounting bracket longitudinally-disposed and concave ended throughslot
34 mounting bracket mounting screws
36 slim, flat, and elongated sliding arm
38 pair of sliding arm free ends
40 sliding arm free end throughbore
42 conventional box lower portion side
44 sliding arm pivoting assembly
46 sliding arm sliding and locking assembly
48 sliding arm pivoting assembly block
50 pair of sliding arm pivoting assembly block spaced-apart and chamfered throughbores
52 sliding arm pivoting assembly block intermediate throughbore
54 sliding arm pivoting assembly block intermediate throughbore wider inner portion
56 sliding arm pivoting assembly block intermediate throughbore narrow outer portion

58 sliding arm pivoting assembly swivel rivet

60 sliding arm pivoting assembly swivel rivet head

62 sliding arm pivoting assembly swivel rivet free end

64 sliding arm mounting screws

66 sliding arm sliding and locking assembly rivet screw

68 sliding arm sliding and locking assembly rivet screw proximal end

70 sliding arm sliding and locking assembly rivet screw threaded shaft

72 sliding arm sliding and locking assembly rivet screw proximal end washer

74 first sliding arm sliding and locking assembly washer

76 second sliding arm sliding and locking assembly washer

78 sliding arm sliding and locking assembly hand turnable nut

DETAILED DESCRIPTION OF THE PREFERRED EMBODIMENT

Referring now to the figures in which like numerals indicate like parts, and particularly to FIG. 1, the lockable lid support of the present invention is shown generally at 10 installed on a conventional box 12 and maintaining a pivotally mounted conventional box lid 14 of the conventional box 12, which is pivotally mounted to a conventional box lower portion 13 of the conventional box 12 by conventional box hinges 15, in a closed position.

It is to be understood that the lockable lid support 10 can be installed to either the inside or the outside of either the right or the left side of the conventional box 12.

Figure 2:
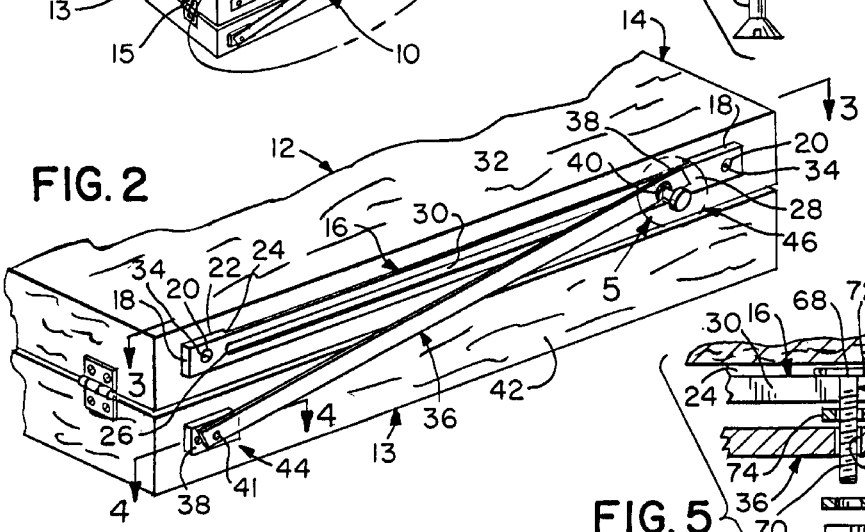
FIG. 2 is an enlarged perspective view of the area enclosed by the dotted ellipse identified by arrow 2 in FIG. 1 and illustrating the components of the present invention in greater detail.
Figure 3:
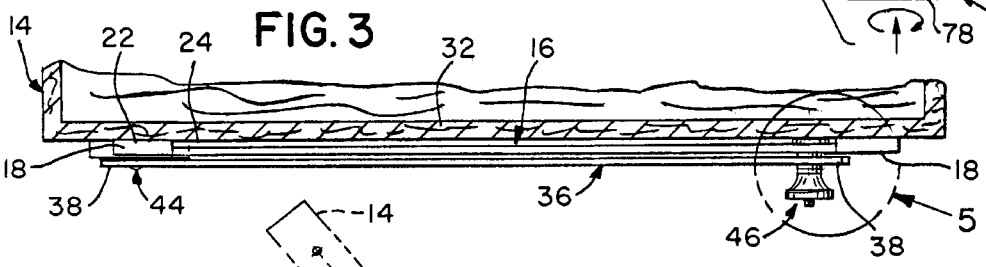
FIG. 3 is an enlarged cross section view with parts broken away and taken on line 3—3 in FIG. 2.

The configuration of the lockable lid support 10 can best be seen in FIGS. 2 and 3, and as such, will be discussed with reference thereto.

The lockable lid support 10 includes a slim, flat, and elongated mounting bracket 16 that has a pair of mounting bracket free ends 18. Each of the pair of mounting bracket free ends 18 of the slim, flat, and elongated mounting bracket 16 has a mounting bracket free end chamfered throughbore 20 that extends therethrough.

The slim, flat, and elongated mounting bracket 16 further has a mounting bracket inner surface 22 with a mounting bracket inner surface longitudinally-disposed and concave ended recess 24 that extends longitudinally along the mounting bracket inner surface 22 of the slim, flat, and elongated mounting bracket 16 from a mounting bracket first free end proximity area 26 which is in proximity to one mounting bracket free end chamfered throughbore 20 of the pair of mounting bracket free ends 18 of the slim, flat, and elongated mounting bracket 16 to a mounting bracket second proximity area 28 which is in proximity to another mounting bracket free end chamfered throughbore 20 of the pair of mounting bracket free ends 18 of the slim, flat, and elongated mounting bracket 16.

The slim, flat, and elongated mounting bracket 16 further has a mounting bracket longitudinally-disposed and concave ended throughslot 30 that extends longitudinally along the slim, flat, and elongated mounting bracket 16 from the mounting bracket first free end proximity area 26 of the one mounting bracket free end chamfered throughbore 20 of the pair of mounting bracket free ends 18 of the slim, flat, and elongated mounting bracket 16 to the mounting bracket second proximity area 28 of the other mounting bracket free end chamfered throughbore 20 of the pair of mounting bracket free ends 18 of the slim, flat, and elongated mounting bracket 16.

The mounting bracket longitudinally-disposed and concave ended throughslot 30 of the slim, flat, and elongated mounting bracket 16 opens into the mounting bracket inner surface longitudinally-disposed and concave ended recess 24 of the mounting bracket inner surface 22 of the slim, flat, and elongated mounting bracket 16, and is thus in communication therewith.

The slim, flat, and elongated mounting bracket 16 is removably mounted to a conventional box lid side 32 of the pivotally mounted conventional box lid 14 of the conventional box 12, by mounting bracket mounting screws 34.

The mounting bracket mounting screws 34 of the slim, flat, and elongated mounting bracket 16 pass through the mounting bracket free end chamfered throughbore 20 of the pair of mounting bracket free ends 18 of the slim, flat, and elongated mounting bracket 16 and into the conventional box lid side 32 of the pivotally mounted conventional box lid 14 of the conventional box 12.

The lockable lid support 10 further includes a slim, flat, and elongated sliding arm 36 that has a pair of sliding arm free ends 38. Each of the pair of sliding arm free ends 38 of the slim, flat, and elongated sliding arm 36 has a sliding arm free end throughbore 40 that extends therethrough.

One of the pair of sliding arm free ends 38 of the slim, flat, and elongated sliding arm 36 is pivotally mounted to a conventional box lower portion side 42 of the conventional box lower portion 13 of the conventional box 12, by a sliding arm pivoting assembly 44.

The sliding arm pivoting assembly 44 is disposed below the one of the pair mounting bracket free ends 18 of the slim, flat, and elongated mounting bracket 16 that is closest the conventional box hinges 15 of the conventional box 12.

Another of the pair of sliding arm free ends 38 of the slim, flat, and elongated sliding arm 36 is slidably and lockingly engaged with the slim, flat, and elongated mounting bracket 16, by a sliding arm sliding and locking assembly 46.

Figure 4:
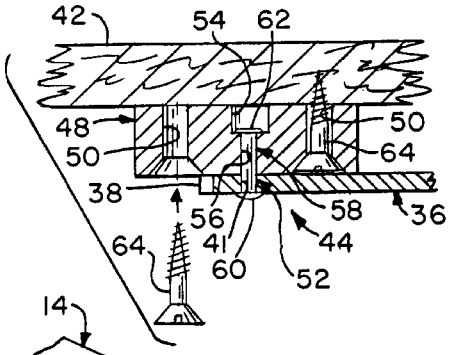
FIG. 4 is an enlarged cross section view with parts broken away and taken on line 4—4 in FIG. 2.

The configuration of the sliding arm pivoting assembly 44 can best be seen in FIG. 4, and as such, will be discussed with reference thereto.

The sliding arm pivoting assembly 44 includes a sliding arm pivoting assembly block 48 that has a pair of sliding arm pivoting assembly block spaced-apart and chamfered throughbores 50 and a sliding arm pivoting assembly block intermediate throughbore 52 that is disposed intermediate the pair of sliding arm pivoting assembly block spaced-apart and chamfered throughbores 50 of the sliding arm pivoting assembly block 48 of the sliding arm pivoting assembly 44.

The sliding arm pivoting assembly block intermediate throughbore 52 of the sliding arm pivoting assembly block 48 of the sliding arm pivoting assembly 44 has a sliding arm pivoting assembly block intermediate throughbore wider inner portion 54 and a sliding arm pivoting assembly block intermediate throughbore narrow outer portion 56 that opens into the sliding arm pivoting assembly block intermediate throughbore wider inner portion 54 of the sliding arm pivoting assembly block intermediate throughbore 52 of the sliding arm pivoting assembly block 48 of the sliding arm pivoting assembly 44 and is thus in communication therewith.

The sliding arm pivoting assembly 44 further includes a sliding arm pivoting assembly swivel rivet 58 that has a sliding arm pivoting assembly swivel rivet head 60 and a sliding arm pivoting assembly swivel rivet free end 62.

The sliding arm pivoting assembly swivel rivet free end 62 of the sliding arm pivoting assembly swivel rivet 58 of the sliding arm pivoting assembly 44 passes through the sliding arm free end throughbore 40 of one of the pair of sliding arm free ends 38 of the slim, flat, and elongated sliding arm 36 and through the sliding arm pivoting assembly block intermediate throughbore narrow outer portion 56 of the sliding arm pivoting assembly block intermediate throughbore 52 of the sliding arm pivoting assembly block 48 of the sliding arm pivoting assembly 44, with the sliding arm pivoting assembly swivel rivet head 60 of the sliding arm pivoting assembly swivel rivet 58 of the sliding arm pivoting assembly 44 resting on the one of the pair of sliding arm free ends 38 of the slim, flat, and elongated sliding arm 36.

The sliding arm pivoting assembly swivel rivet free end 62 of the sliding arm pivoting assembly swivel rivet 58 of the sliding arm pivoting assembly 44 enters the sliding arm pivoting assembly block intermediate throughbore wider inner portion 54 of the sliding arm pivoting assembly block intermediate throughbore 52 of the sliding arm pivoting assembly block 48 of the sliding arm pivoting assembly 44 where it is mashed and widened to a width larger than that of the sliding arm pivoting assembly block intermediate throughbore narrow outer portion 56 of the sliding arm pivoting assembly block intermediate throughbore 52 of the sliding arm pivoting assembly block 48 of the sliding arm pivoting assembly 44.

With this arrangement, the sliding arm pivoting assembly swivel rivet 58 of the sliding arm pivoting assembly 44 is prevented from unintentional removal from the sliding arm pivoting assembly block 48 of the sliding arm pivoting assembly 44 and the slim, flat, and elongated sliding arm 36 is pivotally mounted to the sliding arm pivoting assembly block 48.

The sliding arm pivoting assembly block 48 of the sliding arm pivoting assembly 44 is removably mounted to the conventional box lower portion side 42 of the conventional box lower portion 13 of the conventional box 12, with the sliding arm pivoting assembly block intermediate throughbore wider inner portion 54 of the sliding arm pivoting assembly block intermediate throughbore 52 of the sliding arm pivoting assembly block 48 of the sliding arm pivoting assembly 44 in contact therewith, by sliding arm mounting screws 64.

The sliding arm mounting screws 64 of the sliding arm pivoting assembly 44 pass through the pair of sliding arm pivoting assembly block spaced-apart and chamfered throughbores 50 of the sliding arm pivoting assembly block 48 of the sliding arm pivoting assembly 44 and into the conventional box lower portion side 42 of the conventional box lower portion 13 of the conventional box 12.

Figure 5:
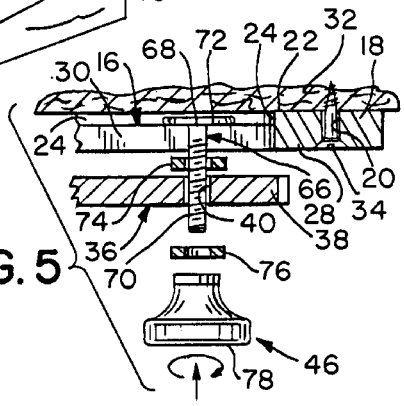
FIG. 5 is an enlarged exploded top plan view in partial cross section of the area enclosed by the dotted circle identified by arrow 5 in FIG. 2.

The configuration of the sliding arm sliding and locking assembly 46 can best be seen in FIG. 5, and as such, will be discussed with reference thereto.

The sliding arm sliding and locking assembly 46 includes a sliding arm sliding and locking assembly rivet screw 66 that has a sliding arm sliding and locking assembly rivet screw proximal end 68 and a sliding arm sliding and locking assembly rivet screw threaded shaft 70.

The sliding arm sliding and locking assembly rivet screw threaded shaft 70 of the sliding arm sliding and locking assembly rivet screw 66 of the sliding arm sliding and locking assembly 46 passes through the mounting bracket longitudinally-disposed and concave ended throughslot 30 of the slim, flat, and elongated mounting bracket 16, with the sliding arm sliding and locking assembly rivet screw proximal end 68 of the sliding arm sliding and locking assembly rivet screw 66 of the sliding arm sliding and locking assembly 46 having a sliding arm sliding and locking assembly rivet screw proximal end washer 72 disposed thereon that is disposed in the mounting bracket inner surface longitudinally-disposed and concave ended recess 24 of the mounting bracket inner surface 22 of the slim, flat, and elongated mounting bracket 16.

The sliding arm sliding and locking assembly rivet screw proximal end washer 72 of the sliding arm sliding and locking assembly rivet screw proximal end 68 of the sliding arm sliding and locking assembly rivet screw 66 of the sliding arm sliding and locking assembly 46 can be a material that will increase its slidability, such as TEFLON or the like, but is not limited to that.

The sliding arm sliding and locking assembly rivet screw proximal end washer 72 of the sliding arm sliding and locking assembly rivet screw proximal end 68 of the sliding arm sliding and locking assembly rivet screw 66 of the sliding arm sliding and locking assembly 46 is wider than the width of the mounting bracket longitudinally-disposed and concave ended throughslot 30 of the slim, flat, and elongated mounting bracket 16 and substantially as thick as the depth of the mounting bracket inner surface longitudinally-disposed and concave ended recess 24 of the mounting bracket inner surface 22 of the slim, flat, and elongated mounting bracket 16, so that the lockable lid support is kept steady and will not rock back and forth.

After the sliding arm sliding and locking assembly rivet screw threaded shaft 70 of the sliding arm sliding and locking assembly rivet screw 66 of the sliding arm sliding and locking assembly 46 passes through the mounting bracket longitudinally-disposed and concave ended throughslot 30 of the slim, flat, and elongated mounting bracket 16, the sliding arm sliding and locking assembly rivet screw threaded shaft 70 of the sliding arm sliding and locking assembly rivet screw 66 of the sliding arm sliding and locking assembly 46 is received by a first sliding arm sliding and locking assembly washer 74.

The first sliding arm sliding and locking assembly washer 74 of the sliding arm sliding and locking assembly 46 is wider than the width of the mounting bracket longitudinally-disposed and concave ended throughslot 30 of the slim, flat, and elongated mounting bracket 16 and can be a material that will increase its slidability, such as TEFLON or the like but is not limited to that.

The sliding arm sliding and locking assembly rivet screw threaded shaft 70 of the sliding arm sliding and locking assembly rivet screw 66 of the sliding arm sliding and locking assembly 46 then passes through the sliding arm free end throughbore 40 of the other one of the pair of sliding arm free ends 38 of the slim, flat, and elongated sliding arm 36.

After the sliding arm sliding and locking assembly rivet screw threaded shaft 70 of the sliding arm sliding and locking assembly rivet screw 66 of the sliding arm sliding and locking assembly 46 passes through the sliding arm free end throughbore 40 of the other one of the pair of sliding arm free ends 38 of the slim, flat, and elongated sliding arm 36, the sliding arm sliding and locking assembly rivet screw threaded shaft 70 of the sliding arm sliding and locking assembly rivet screw 66 of the sliding arm sliding and locking assembly 46 is received by a second sliding arm sliding and locking assembly washer 76.

The second sliding arm sliding and locking assembly washer 76 of the sliding arm sliding and locking assembly 46 is wider than the width of the mounting bracket longitudinally-disposed and concave ended throughslot 30 of the slim, flat, and elongated mounting bracket 16 and can be a material that will increase its slidability, such as TEFLON or the like but is not limited to that.

After the sliding arm sliding and locking assembly rivet screw threaded shaft 70 of the sliding arm sliding and locking assembly rivet screw 66 of the sliding arm sliding and locking assembly 46 passes through the second sliding arm sliding and locking assembly washer 76 of the sliding arm sliding and locking assembly 46, the sliding arm sliding and locking assembly rivet screw threaded shaft 70 of the sliding arm sliding and locking assembly rivet screw 66 of the sliding arm sliding and locking assembly 46 is threadably received by a sliding arm sliding and locking assembly hand turnable nut 78.

The sliding arm sliding and locking assembly hand turnable nut 78 of the sliding arm sliding and locking assembly 46 may be wider than the slim, flat, and elongated sliding arm 36 but is not limited to that.

The first sliding arm sliding and locking assembly washer 74 of the sliding arm sliding and locking assembly 46 and the second sliding arm sliding and locking assembly washer 76 of the sliding arm sliding and locking assembly 46 help guide the slim, flat, and elongated sliding arm 36.

Figure 6:
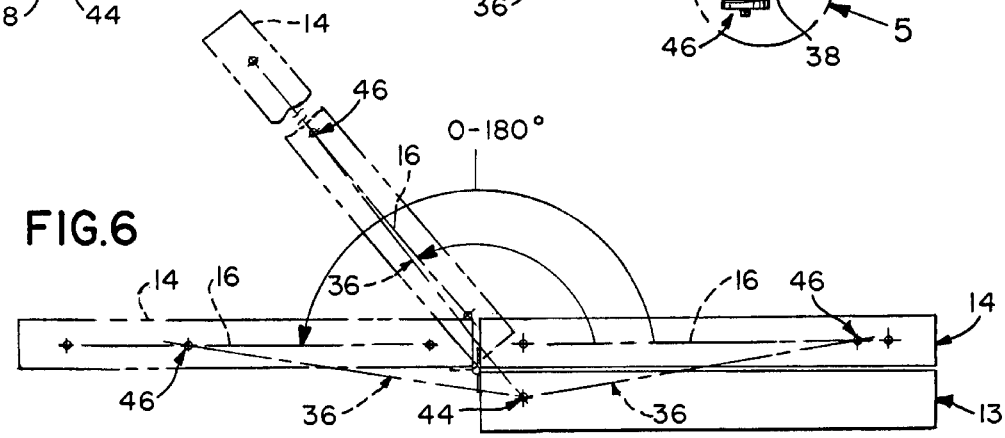
FIG. 6 is a diagrammatic side elevational view illustrating the range of motion of the box lid utilizing the present invention.

The range of motion of the lockable lid support 10 and its general operation can best be seen in FIG. 6, and as such, will be discussed with reference thereto.

The sliding arm sliding and locking assembly hand turnable nut 78 of the sliding arm sliding and locking assembly 46 is turned by hand and loosened.

The pivotally mounted conventional box lid 14 of the conventional box 12 is raised relative to the conventional box lower portion 13 of the conventional box 12.

As the pivotally mounted conventional box lid 14 of the conventional box 12 is raised, the sliding arm sliding and locking assembly rivet screw threaded shaft 70 of the sliding arm sliding and locking assembly rivet screw 66 of the sliding arm sliding and locking assembly 46 is caused to traverse along the mounting bracket longitudinally-disposed and concave ended throughslot 30 of the slim, flat, and elongated mounting bracket 16.

When the desired position of the pivotally mounted conventional box lid 14 of the conventional box 12 is obtained, which can be from 0 to 180 degrees, the sliding arm sliding and locking assembly hand turnable nut 78 of the sliding arm sliding and locking assembly 46 is turned by hand and tightened and thereby causing the slim, flat, and elongated sliding arm 36 to be held to the slim, flat, and elongated mounting bracket 16.

The lockable lid support 10 can be used, but is not limited to, in maintaining the pivotally mounted conventional box lid 14 of the conventional box 12 in a desired position relative to the conventional box lower portion 13 of the convention box 12 in a method of using the conventional box lower portion 13 of the conventional box 12 as a pallet and a storage area for painting supplies and the pivotally mounted conventional box lid 14 of the conventional box 12 as an easel.

The adjustability of the lockable lid support 10 allows the pivotally mounted conventional box lid 14 of the conventional box 12, that is being used as an easel, to be raised to any angle convenient for the user regardless of the angle of the surface that the conventional box lower portion 13 of the conventional box 12 is resting on.

It will be understood that each of the elements described above, or two or more together, may also find a useful application in other types of constructions differing from the types described above.

While the invention has been illustrated and described as embodied in a self-locking lid support, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A lockable lid support, comprising:

a) a mounting bracket removably mounted to an outer surface of a side of a lid of a box so as not to impede upon the storage space contained in the lid of box; the lid of the box being pivotally mounted to a lower portion of the box; said mounting bracket being slim, flat, and elongated and having a pair of ends removably mounted to the outer surface of the side of the lid of the box so as not to impede upon the storage space contained in the lid of the box; each of said pair of ends of said slim, flat, and elongated mounting bracket having a chamfered throughbore; said slim, flat, and elongated mounting bracket further having an inner surface, an upper edge, and a lower edge disposed opposite said upper edge of said slim, flat, and elongated mounting bracket; said inner surface of said slim, flat, and elongated mounting bracket having a longitudinally-disposed and concave ended recess with a depth and extending longitudinally along said inner surface of said slim, flat, and elongated mounting bracket from a first proximity area which is in proximity to said chamfered throughbore in one of said pair of ends of said slim, flat, and elongated mounting bracket to a second proximity area which is in proximity to said chamfered throughbore in another of said pair of ends of said slim, flat, and elongated mounting bracket, and opening into said upper edge of said slim, flat, and elongated mounting bracket and said lower edge of said slim, flat, and elongated bracket; said slim, flat, and elongated mounting bracket further having a longitudinally-disposed and concave ended throughslot with a width and extending longitudinally along said slim, flat, and elongated mounting bracket from said first proximity area of said slim, flat, and elongated mounting bracket to said second proximity area of said slim, flat, and elongated mounting bracket; said longitudinally-disposed and concave ended throughslot in said slim, flat, and elongated mounting bracket opening into said longitudinally-disposed and concave ended recess in said inner surface of said slim, flat, and elongated mounting bracket;

b) an arm pivotally mounted at one end to an outer surface of a side of the lower portion of the box so as not to impede upon the storage space contained in the lower portion of the box, and slidably and locking mounted at another end to said mounting bracket; said arm being slim, flat, and elongated and having a pair of ends; each of said pair of ends of said slim, flat, and elongated sliding arm having a throughbore;

c) pivoting means for pivotally mounting said one end of said slim, flat, and elongated sliding arm to the outer surface of the side of the lower portion of the box so as not to impede upon the storage space in the lower portion of the box and so as to allow the lid of the box to be pivoted relative to the lower portion of the box from 0 degrees to 180 degrees; one of said pair of ends of said slim, flat, and elongated sliding arm being pivotally mounted to the outer surface of the side of the lower portion of the box by said pivoting means so as not to impede upon the storage space contained in the lower portion of the box; said pivoting means including a block being rectangular-parallelepiped-shaped and having a pair of spaced-apart, parallel, and chamfered throughbores and an intermediate throughbore disposed intermediate and parallel to said pair of spaced-apart, parallel, and chamfered throughbores in said block of said pivoting means; said intermediate throughbore in said block of said pivoting means having a wide inner portion abutting against the outer surface of the side of the lower portion of the box so as not to impede upon the storage space contained in the lower portion of the box and a narrow outer portion opening into and being narrower than and extending coaxially from said wide inner portion of said intermediate throughbore in said block of said pivoting means; said pivoting means further including a swivel rivet having a head and a distal end; said distal end of said swivel rivet of pivoting means passing through said throughbore in one of said pair of ends of said slim, flat, and elongated sliding arm and through said narrow outer portion of said intermediate throughbore in said block of said pivoting means with said head of said swivel rivet of said pivoting means resting on said one of said pair of ends of said slim, flat, and elongated sliding arm; said distal end of said swivel rivet of said pivoting means entering said wide inner portion of said intermediate throughbore in said block of said pivoting means where it widens to a width larger than that of said narrow outer portion of said intermediate throughbore in said block of said pivoting means and being captured between said block of said pivoting means and the outer surface of the side of the lower portion of the box so as to prevent said swivel rivet of said pivoting means from unintentional removal from said block of said pivoting means and to allow said slim, flat, and elongated sliding arm to be pivotally mounted to said block of said pivoting means;

d) sliding and locking means for slidingly and lockingly mounting said another end of said slim, flat, and elongated sliding arm to said mounting bracket so as to allow the lid of the box to be maintained in any position from 0 degrees to 180 degrees relative to the lower portion of the box when the lid of the box is pivoted relative to the lower portion of the box; another of said pair of ends of said slim, flat, and elongated sliding arm being slidably and lockingly engaged with said slim, flat, and elongated mounting bracket by said sliding and locking means; said sliding and locking means including a rivet screw having a proximal end and a threaded shaft with a distal end; said distal end of said threaded shaft of said rivet screw of said sliding and locking means passing through said longitudinally-disposed and concave ended throughslot in said slim, flat, and elongated mounting bracket and passing through said throughbore in another of said pair of ends of said slim, flat, and elongated sliding arm; said sliding and locking means further including a proximal washer having a width and a thickness and being disposed on said proximal end of said rivet screw of said sliding and locking assembly and being positioned in said longitudinally-disposed and concave ended recess in said inner surface of said slim, flat, and elongated mounting bracket; said width of said proximal washer of said proximal end of said rivet screw of said sliding and locking means being greater than said width of said longitudinally-disposed and concave ended throughslot in said slim, flat, and elongated mounting bracket and said thickness of said proximal washer of said proximal end of said rivet screw of said sliding and locking means being substantially equal to said depth of said longitudinally-disposed and concave ended recess in said inner surface of said slim, flat, and elongated mounting bracket so as to keep said lockable lid support steady and prevented from rocking back and forth; and e) block mounting means for removably mounting said block of said pivoting means to the outer surface of the side of the lower portion of the box so as not to impede upon the storage space contained in the lower portion of the box; said block mounting means including screws passing through said pair of spaced-apart, parallel, and chamfered throughbores in said block of said pivoting means and into the outer surface of the side of the lower portion of the box.

2. The support as defined in claim 1, further comprising mounting bracket mounting means for removably mounting said mounting bracket to the outer surface of the side of the lid of the box.

3. The support as defined in claimed 2, wherein said mounting bracket mounting means includes screws that pass through said chamfered throughbore in each of said pair of ends of said slim, flat, and elongated mounting bracket and into the outer surface of the side of the lid of the box.

4. The support as defined in claim 1, wherein said sliding and locking means further includes an intermediate washer that is disposed on said threaded shaft of said rivet screw of said sliding and locking means between said slim, flat, and elongated mounting bracket and said slim, flat, and elongated mounting bracket so as to help guide said slim, flat, and elongated sliding arm.

5. The support as defined in claim 4, wherein said sliding and locking means further includes a distal washer that is disposed on said threaded shaft of said rivet screw of said sliding and locking assembly adjacent a side of said slim, flat, and elongated sliding arm opposite to said intermediate washer of said sliding and locking means so as to further help guide said slim, flat, and elongated sliding arm.

6. The support as defined in claim 5, wherein said sliding and locking means further includes a hand turnable nut that is removably mounted to said distal end of said threaded shaft of said rivet screw of said sliding and locking means adjacent to said distal washer of said sliding and locking means.

* * * * *